US006695502B2

(12) United States Patent
Marsh

(10) Patent No.: US 6,695,502 B2
(45) Date of Patent: Feb. 24, 2004

(54) METHOD FOR REDUCING RUB-OFF FROM A TONER IMAGE USING A PHASE CHANGE COMPOSITION ON THE NON-IMAGE SIDE OF A SUBSTRATE

(75) Inventor: Dana G. Marsh, Newark, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 17 days.

(21) Appl. No.: 10/190,784

(22) Filed: Jul. 8, 2002

(65) Prior Publication Data

US 2003/0039753 A1 Feb. 27, 2003

Related U.S. Application Data

(60) Provisional application No. 60/310,876, filed on Aug. 8, 2001.

(51) Int. Cl.[7] ..... B41J 13/00

(52) U.S. Cl. ..... 400/624; 400/120.01; 399/324; 399/320; 420/124

(58) Field of Search ..... 400/624, 625, 400/628, 118.3, 120.01; 399/320, 324, 325; 430/124

(56) References Cited

U.S. PATENT DOCUMENTS 3,653,932 A 4/1972 Berry et al.
3,715,219 A 2/1973 Kurz et al.
3,984,809 A 10/1976 Dertouzos et al.
4,250,511 A 2/1981 Stein et al.
4,390,369 A 6/1983 Merritt et al.
4,447,818 A 5/1984 Kurata et al.
4,458,253 A 7/1984 Goff, Jr. et al.
4,484,948 A 11/1984 Merritt et al.
4,490,731 A 12/1984 Vaught
4,568,949 A 2/1986 Muranaka
4,659,383 A 4/1987 Lin et al.
4,666,757 A 5/1987 Helinski
4,721,635 A 1/1988 Helinski
4,745,420 A 5/1988 Gerstenmaier
4,851,045 A 7/1989 Taniguchi
4,889,560 A 12/1989 Jaeger et al.
5,006,170 A 4/1991 Schwaz et al.
5,052,336 A * 10/1991 Fukuchi ..... 399/104
5,092,235 A 3/1992 Rise
5,151,120 A 9/1992 You et al.
5,182,572 A 1/1993 Merritt et al.
5,185,035 A 2/1993 Brown et al.
5,209,464 A * 5/1993 Bermel et al. ..... 271/35
5,372,852 A 12/1994 Titterington et al.
5,389,958 A 2/1995 Bui et al.
5,495,270 A 2/1996 Burr et al.
5,541,624 A 7/1996 Cooke et al.
5,569,540 A 10/1996 Hirose et al.
5,598,195 A 1/1997 Okamoto et al.
5,672,413 A 9/1997 Taylor et al.
5,827,918 A 10/1998 Titterington et al.
5,830,942 A 11/1998 King et al.
5,879,790 A 3/1999 Sogabe et al.
5,922,114 A 7/1999 Sawada
5,954,865 A 9/1999 Sawada
5,958,169 A 9/1999 Titterington et al.
5,966,150 A 10/1999 Lester et al.
5,980,621 A 11/1999 Inaishi et al.
5,994,453 A 11/1999 Banning et al.
6,015,847 A 1/2000 Titterington et al.
6,018,005 A 1/2000 Banning et al.

(List continued on next page.)

*Primary Examiner*—Andrew H. Hirshfeld
*Assistant Examiner*—Dave A. Ghatt

(57) ABSTRACT

A method for reducing rub-off by employing a substrate having a front side and a back side with the front side bearing a toner image by depositing a phase change composition on the non-image bearing side of the substrate as a plurality of dots, with the plurality of dots cumulatively covering an area of the non-image bearing side sufficient to reduce rub-off from the image bearing side of an adjacent substrate.

36 Claims, 8 Drawing Sheets

U.S. PATENT DOCUMENTS 6,022,910 A 2/2000 Nishizaki et al.
6,028,138 A 2/2000 Hahn et al.
6,037,396 A 3/2000 Sawada
6,048,925 A 4/2000 Titterington et al.
6,057,385 A 5/2000 Syutara et al.
6,063,729 A 5/2000 Eguchi et al.
6,567,642 B2 * 5/2003 Marsh ..... 399/341

* cited by examiner

METHOD FOR REDUCING RUB-OFF FROM A TONER IMAGE USING A PHASE CHANGE COMPOSITION ON THE NON-IMAGE SIDE OF A SUBSTRATE

RELATED APPLICATIONS

This application is entitled to and hereby claims the benefit of the filing date of U.S. provisional application Ser. No. 60/310,876 filed Aug. 8, 2001.

FIELD OF THE INVENTION

This invention relates to a method for reducing rub-off from a substrate, such as paper, having a toner image on only one side of the substrate by depositing a plurality of dots of a substantially clear phase change composition on the non-image bearing side of the substrate with said dots cumulatively covering an area of said non-image bearing side sufficient to reduce image rub-off from the image bearing side of an adjacent substrate. This invention further relates to the use of a phase change composition deposited on the side of a cover sheet that is contiguous with the image bearing side of an adjacent substrate to prevent rub-off from said adjacent substrate.

BACKGROUND OF THE INVENTION

In electrophotographic copying processes, images are formed on selected substrates, typically paper, using small, dry, colored particles called toner. The thermoplastic toner is typically attached to a print substrate by a combination of heat and pressure using a fusing subassembly that partially melts the toner into the paper fibers at the surface of the paper substrate. Typically, in an electrophotographic printer, a heated fuser roller is used with a pressure roller to attach toner to a receiver and to control the surface image characteristics.

Fused toner images can be substantially abraded or "rubbed-off" by processes such as duplex imaging, folding, sorting, stapling, binding, and filing and the like. Residue from this abrasion process causes objectionable and undesirable marks on non-imaged areas of adjacent pages or covers. This process, and image quality defect, are known as "rub-off" and exist to varying extents in many electrophotographic copies and prints. The basic "requirements" for generation of rub-off are a donor (toner image), a receptor (adjacent paper page, envelope, mailing label, etc.), a differential velocity between donor and receptor, a load between donor and receptor and pressing them together. Toner rub-off may be reduced by the use of tougher toner, lower surface energy toner materials (resulting in lower coefficient of friction), better fused toner, and a smoother toner image surface finish (causing increased image gloss.) Unfortunately, as described in detail hereinafter, there are undesirable consequences associated with each of the above rub-off reduction factors. Extensive efforts have been directed to the development of improved methods for reducing rub-off without modification of the fusing process.

SUMMARY OF THE INVENTION

According to the present invention, rub-off from a substrate bearing a toner image is reduced by a method for reducing rub-off by employing a first substrate having a front image bearing side and a back non-image bearing side, the method comprising: depositing a substantially clear phase change composition on the back side of the substrate which does not have a toner image as a plurality of dots, the dots cumulatively covering an area of said non-image bearing side sufficient to reduce rub-off from the toner image bearing side of a separate substrate that is adjacent to the back side of said first substrate.

The invention further relates to a method of reducing rub-off from a first substrate having a front side and a back side and a plurality of printer, copier, or digital copier produced toner images on said front side and no toner images on said back side, the method comprising: providing a cover substrate contiguous with said front side of said first substrate, depositing on the side of said cover substrate that is adjacent to said front side of said first substrate a substantially clear phase change composition as a plurality of dots, the dots cumulatively covering an area of the cover substrate sufficient to reduce rub-off from said front side of said first substrate.

DESCRIPTION OF THE PREFERRED EMBODIMENTS

Figure 1:
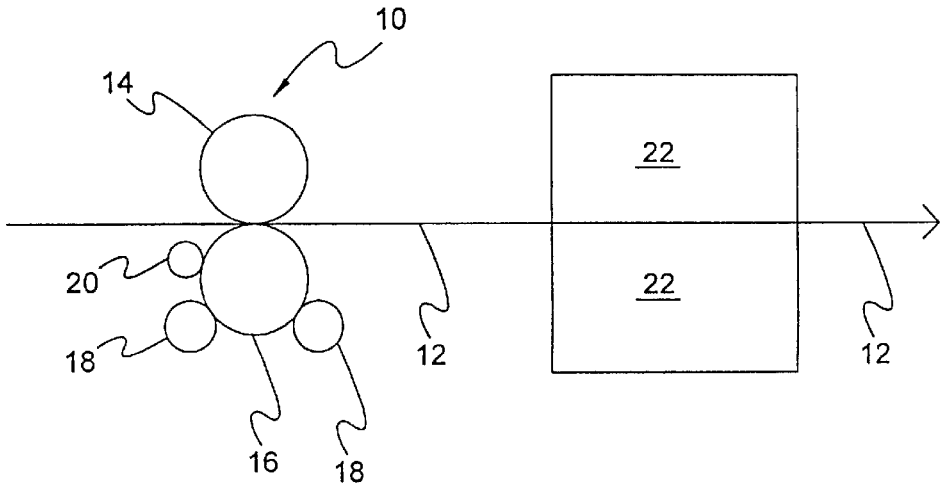
FIG. 1 shows an embodiment of the present invention.

Many electrophotographic processes produce prints or copies, which have a high rub-off of toner onto adjacent receiver sheets that is considered unacceptable by some users. The amount of rub-off depends upon the particular machine hardware, oiling rates and the like. Typical values from 19 to 25 are measured at 3 psi (pounds per square inch) using the test procedure described herein for copies that have been aged for about 100 hours.

The existing toners in some instances do not have a wax lubricant and offer little protection against rub-off. The electrophotographic process typically forms images on selected substrates, typically paper, using small, dry, colored particles called toner. Toners usually comprise a thermoplastic resin binder, dye or pigment colorants, charge control additives, cleaning aids, fuser release additives and optionally, flow control and tribocharging control surface treatment additives.

The thermoplastic toner is typically attached to a print substrate by a combination of heat and pressure using a fusing subassembly that partially melts the toner into the paper fibers at the surface of the paper substrate. The fused toner image surface finish is affected and controlled by the fuser roller surface finish. Thus, gloss of the image may be controlled between diffuse (low gloss) and specular (high gloss). When the surface finish of the image is rough (diffuse), the light is scattered and image gloss is reduced.

Typically in an electrophotographic printer, a heated fuser roller is used with a pressure roller to attach toner to a receiver and to control the toner image surface characteristics. Heat is typically applied to the fusing roller by a resistance heater such as a halogen lamp. Heat can be applied to the inside of at least one hollow heater roller and/or to the surface of at least one heater roller. At least one of a pressure roller and a fuser roller is typically compliant.

When the rollers of a heated roller fusing assembly are pressed together under pressure, the compliant roller deflects to form a fusing nip. Most heat transfer between the surface of the fusing roller and the toner occurs in the fusing nip. In order to minimize "offset," which is the amount of toner that adheres to the surface of the fuser roller; release oil is typically applied to the surface of the fuser roller. Typically, the release oil is silicone oil plus additives, which improve attachment of the release oil to the surface of the fuser roller and dissipate static charge buildup on the fuser rollers or fused prints. Some of the release oil becomes attached to the image and background areas of the fused prints.

Certain characteristics of the fused toner image are inherent. Since the fused toner is only partially melted, it does not completely penetrate into the paper fibers on the surface of the paper. The toner image forms a relief image and projects above the surface of the paper. The height of the toner image above the surface of the paper substrate is dependent on the particle size of the toner particles. Small particles result in a lower image height. The thermo-mechanical properties of the toner, such as melting point, glass transition temperature, and rheological flow characteristics also affect rub-off.

In general, the mechanisms of rub-off are consistent with those of abrasive and adhesive wear mechanisms. Relevant factors include: toner toughness, toner brittleness (cross-linking density), surface energy or coefficient of friction of the toner, adhesion of the toner to the paper substrate, cohesive properties of the toner itself, the surface topography of the toner image, the level of load and the differential velocities of the wearing surfaces. Some of these factors are under the control of the machine and materials manufacturers and some are under the control of the end user.

As mentioned hereinbefore, toner rub-off may be reduced by the use of tougher toner, lower surface energy toner materials (resulting in a lower coefficient of friction), better-fused toner, and a smoother toner image surface finish (causing increased image gloss).

As mentioned earlier, there are undesirable consequences associated with each of the above rub-off reduction factors. A tougher toner is more difficult to pulverize, grind, and classify, which increases manufacturing costs. Additionally, smaller toner particle size distributions are more difficult to achieve with tougher toner. Adding wax to the toner may provide additional release properties from the fuser roller surface and may add lubrication to the surface of the toner, but triboelectric charging behavior may be adversely affected. A more easily fusible toner may create more toner offset to the surface of the fuser rollers, or increase the tendency of fused prints or copies to stick together in the finisher or output trays. Creating a more specular (smoother) image surface finish increases image gloss, which may be objectionable in some applications. Fuser release oil can lower the coefficient of friction of the fused image, but this effect is temporary since the oil is adsorbed into the paper substrate over time. Fuser release oil can also cause undesirable effects to the rest of the electrophotographic process, especially in duplex printing operation. The use of wax jet technology, ribbon printing or diffusion printing to deposit a phase change composition, e.g., hot melt wax, to pre-printed paper documents, is a technique for reducing toner rub-off that is not susceptible to the above-mentioned disadvantages.

Hot melt type inks, also referred to as phase change inks, typically comprise a carrier such as a polymeric or wax material and a colorant. Ink jet, ribbon, and diffusion printing systems and other phase change composition systems are known to those skilled in the art and use phase change composition inks (hot melt type ink).

Ink jet, ribbon and diffusion printing systems typically provide the capability of providing a resolution of about 300 or more dpi (dots per inch). When printing a square matrix with such printers, it is possible to print with a resolution equal to 300 dpi in both a cross-track and an in-track direction. This produces a square of print dots, referred to as a matrix, which contains the potential for 300 dots along each axis. This resolution provides excellent print quality. For convenience, all printing resolutions will hereinafter be reported as cross-scan versus in-scan dpi resolutions. Ink jet print heads, ribbon printers and diffusion process printers having lesser resolutions of 50×300, 100×300, 200×300 dpi and the like are also available. Further, printers having a 300×300 dpi resolution can be programmed to produce dots at a lesser cross-track frequency. Such printers produce single pixel ink drops, which are positioned onto the substrate where they instantly solidify. The single pixels are typically from about 12 to about 14 microns in height and form a dot which is typically about 83 microns in diameter and which typically contains about 80 nanograms of material per pixel. Such ink jet printers, ribbon printers and thermal diffusion printing systems are considered to be well known to those skilled in the art and are readily available.

In the present invention, thermal transfer process technology, which is not susceptible to the disadvantages accompanying modification of the toner and the like, is used. In the present invention, at least one phase change composition is used. The phase change composition dots are applied by an ink jet, ribbon or thermal diffusion printer.

Ribbon printers comprise the use of hot melt thermal transfer sheets formed by coating a phase change composition on one side of a substrate film to form a sheet (ribbons) which is then used as a thermal transfer sheet (ribbon) for printing dots on the, substrate. Such thermal transfer ribbons are well known to those skilled in the art.

In the present invention, a ribbon printer having a plurality of individually addressable thermal elements arranged in a cross-process direction in contact with a full width thermal transfer sheet (ribbon) bearing the phase change composition material located in end-to-end relation across the process direction of motion of the substrate bearing the toner image is brought into contact with a non-image bearing side of the substrate or a side of a cover substrate and the thermal elements are selectively activated to deposit dots of the phase change composition in a desired amount on the non-image bearing side of the substrate. The thermal elements that are in direct contact with the thermal transfer sheet are activated to produce heat, which melts the phase change composition. The carrier ribbon is positioned to extend across the width of the substrate bearing the toner image on the opposite side (non-image bearing) of the substrate and is gradually advanced parallel to the substrate flow direction to provide new thermal transfer sheet as required for deposition of the dots by activation of the thermal elements. The thermal transfer sheet (ribbon) is in direct contact with the substrate surface in this embodiment. Desirably, the dots are deposited over a relatively limited area of the substrate side that has no toner image in an amount sufficient to reduce rub-off of the toner image from a separate, adjacent image bearing substrate sheet, which is typically paper.

Accordingly, this thermal transfer print head (ribbon printer) functions by transferring phase change composition from the carrier ribbon directly to the non-toner bearing side of the substrate as the substrate is moved across the print head with the ribbon and the substrate being in a contact relationship. As a result of the direct contact, no aerosol sprays or wax or other resulting contamination on mechanical and electrical parts is anticipated.

An alternate process known as a thermal diffusion, diffusion, dye diffusion or a dye sublimation process also uses a print head with a plurality of individually energizable heating elements and a carrier sheet (ribbon) bearing the phase change composition. In this diffusion process, intimate contact is not required but the ribbon is separated from the substrate by a small gap, typically about 0.001 inches. In this instance, the thermal elements are activated to melt the wax and allow it to diffuse across the small gap. Laser scanning assemblies may also be used as a replacement for thermal print head technology for this application.

These technologies may be used for the direct application of wax onto the non-printed side of preprinted pages or substrates. Also the phase change material may be applied only to the side of a cover page that bears no toner images on either of its sides (or only on one side) and with a non-toner side abutting a separate but contiguous page that does bear toner images. These technologies result in substantially instant freezing of the droplets on the substrate or page and actual penetration of the droplets into the page is minimized. Accordingly, the droplets do not spread substantially after encountering a page. Therefore, multiple discrete areas of phase change composition may be applied as a predefined pattern of data onto the sheet.

These techniques and the use of ink jet printers are considered to be well known to those skilled in the art and no further discussion of these techniques is considered necessary. They are used in the present invention as known vehicles to deposit the droplets onto the substrate to reduce rub-off in the inventive process.

Some systems of this type are shown in U.S. Pat. Nos. 3,984,809; 4,458,253; 4,568,949; 4,851,045; 5,879,790; and 6,057,385.

Phase change inks (hot melt inks) are desirable for ink jet, ribbon and diffusion printers because they remain in a solid state at room temperature during storage and shipment. In addition, problems associated with ink evaporation are eliminated and improved printing reliability is achieved. When drops of the hot melt ink are applied directly onto a substrate, such as paper, the drops solidify immediately on contact with the substrate and migration of ink on the surface of the substrate is prevented.

Hot melt waxes developed for full process color printing in graphics arts applications contain a wax vehicle, colorants, surfactants and dispersants to enable compatibility of the dye with anti-oxidants, cross-linking agents and the like. These waxes are also desirably modified to prevent crystallinity that will negatively impact the color hue.

Colorless hot melt waxes for use in rub-off reduction of electrophotographic toner images do not require surfactants, dispersants or dye. They may contain slip agents, such as organic stearates, to provide low surface energy properties to avoid offsetting of the wax material to receiver substrates. These waxes are preferentially crystalline to enable low gloss. Therefore, high melting waxes with sharp melting point ranges are desirable. Preferably, the waxes or other polymeric materials used have a melting point from about 80 to about 130° C. with a melting range (starts-to-melt to starts-to-freeze range) of about 15° C., and desirably about 10° C. Preferably these waxes or other polymeric materials are crystalline in solid form, have a low coefficient of friction and are odorless. Some suitable materials are waxes, polyethylene, polyalphaolefins, and polyolefins.

U.S. Pat. No. 5,958,169 discloses various hot wax compositions for use in ink jet printers. U.S. Pat. No. 6,018,005 discloses the use of urethane isocyanates, mono-amides, and polyethylene wax as hot melt wax compositions. The polyethylene is used at about 30 to about 80 percent by weight and preferably has a molecular weight between about 800 and about 1200.

U.S. Pat. No. 6,028,138 discloses phase change ink formulations using urethane isocyanate-derived resins, polyethylene wax, and a toughening agent. U.S. Pat. No. 6,048,925 discloses urethane isocyanate-derived resins for use in a phase change ink formulation. Both of these references disclose the use of a hydroxyl containing toughening agent. Additional formulations are disclosed in U.S. Pat. Nos. 5,922,114; 5,954,865; 5,980,621; 6,022,910; and, 6,037,396.

U.S. Pat. No. 5,994,453 discloses phase change carrier compositions made by the combination of at least one urethane resin, at least one urethane/urea resin, at least one mono-amide and at least one polyethylene wax. This reference discloses further that the polyethylene may be employed as an overcoat on a printed substrate. The overcoat is supplied to protect from about 1 to about 25 percent of the surface area of the printed substrate. The treatment is disclosed to give enhanced anti-blocking properties to the prints and to provide enhanced document feeding performance of the ink-bearing substrates for subsequent operations, such as photocopying. This reference discloses the use of printing comprising images of phase change waxes, which are treated by over-spraying the substrate bearing the images of phase change waxes. The reference does not address in any way the treatment of substrates bearing toner images. Toner images, as discussed above, are radically different than phase change ink images in their properties. Further, this reference does not address the reduction of rub-off of toner images.

All of the patents noted above are hereby incorporated in their entirety by reference.

According to the present invention, rub-off of toner images from a first substrate having a front side and a back side and bearing a toner image on only one side, for example, said front side, is reduced by depositing a plurality of dots of a substantially clear phase change composition on the back side of a second substrate which back side does not bear a toner image, said dots cumulatively covering an area of said back side sufficient to reduce image rub-off from the first substrate that has a toner image bearing side that faces and is adjacent to (contiguous with) said back side of said second substrate.

In FIG. 1, a schematic diagram of an embodiment of the present invention is shown. The embodiment shown includes a fusing assembly 10, which includes a process flow of a suitable substrate, such as paper, shown by line 12. A pressure roller 14 and a fuser roller 16 are in engagement to create a nip to perform a heat/pressure treatment of the toner on the paper. As well known to those skilled in the art, heater rollers 18 may be used to heat the fuser roller 16 and a wick roller 20 is typically used to supply a suitable oil to fuser 16. An ink jet, ribbon, laser addressed thermal transfer, or other diffusion type printer 22 may be used on either or both sides of the substrate, depending upon which side a toner image is positioned.

Figure 8:
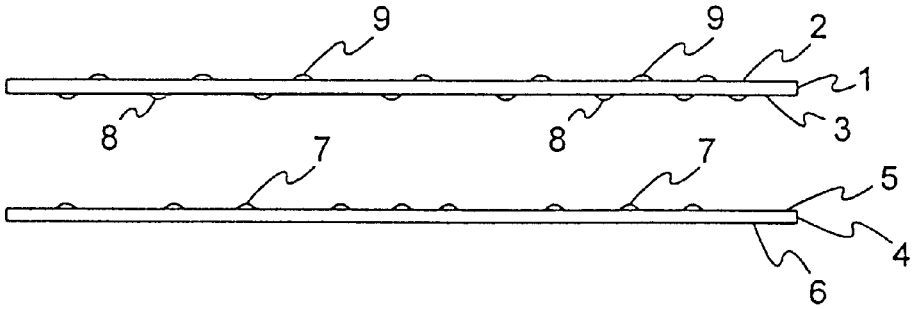
FIG. 8 shows an embodiment of this invention.

In FIG. 8 there is shown a first substrate 1, for example, a sheet of paper, having a front side 2 and a back side 3.

Immediately below substrate 1 is second substrate 4, a separate sheet of paper, having a front side 5 and a back side 6. Substrates 1 and 4 are shown to be spaced apart in FIG. 8 only for the sake of clarity. Normally substrates 1 and 4 are adjacent to one another, i.e., sides 3 and 5 are essentially contiguous, so that upon relative motion between substrates 1 and 4, back side 3 physically rubs against front side 5. If front side 5 of adjacent substrate 4 carries a plurality of toner images 7 thereon the aforesaid relative motion can cause some rub-off of image 7 as explained in detail hereinabove. By this invention, a plurality of clear (colorless) phase change composition dots 8 are dispersed on the non-image bearing side 3 of substrate 1 in an amount and over an area of side 3 sufficient to reduce rub-off of the adjacent images 7 from side 5 of separate substrate 4. Often front side 2 of substrate 1 will carry a plurality of toner images 9 thereon, and substrates 1 and 4 will be but two sheets in a stack of two or more sheets of paper. However, if substrate 4 is the first or only page of a document and substrate 1 is a bare cover (protective) sheet, substrate 1 will have no toner images 9 thereon, but rather will bear no toner image on either of sides 2 and 3. However, the use of this invention on the non-image bearing side 3 of a cover sheet that has no image on its front side 2 will still aid in the prevention of rub-off of images 7 from adjacent substrate 4.

The toner image on the substrate may be positioned on the lower side of the substrate and the ink jet, ribbon or laser addressed thermal transfer printer providing the dot matrix on the substrate will be positioned above the substrate. Alternatively, the ink jet, ribbon or laser addressed thermal transfer printer may be above a substrate having a toner image on its lower side and is still effective to deposit the dots on the surface of this substrate that does not bear a toner image. Such variations are well known to those skilled in the art. Further, fuser assemblies, ink jet printers, ribbon printers, laser addressed thermal transfer and other diffusion-type printers are well known to those skilled in the art and need not be discussed in detail.

The dots deposited by an ink jet printer described above may cumulatively cover from about 0.25 to about 8.00 percent of the total area of the front side of the substrate. Preferably, the coverage is from about 0.25 to about 6.00 percent. Typically, the dots are deposited in a matrix pattern since the ink jet head is capable of depositing the dots as a plurality of pixels at a spacing of 300×300 dpi. Desirably, the dots as positioned on the substrate have a resolution from about 50×300 to about 300×300 dpi and preferably resolution is at least about 100×300 dpi.

The dots may be arranged in a plurality of patterns. For instance, the dots may be arranged in a square matrix pattern. Such square matrix patterns suffer the disadvantage that when a second sheet in contact with a first sheet bearing a toner image is moved relative to the first sheet, rub-off can occur in streaks corresponding to the area between the dots. Another configuration comprises the use of lines of dots. These lines can be placed in any orientation from perpendicular to or diagonal to the anticipated line of movement of a contacting second page of paper or the like. Further, the lines can be used in a square matrix. In any instance, it is desirable that the lines be spaced at a distance less than about 1 (one) inch.

Preferably, the dots are arranged in a random matrix pattern. The use of the random matrix arrangement results in a dot pattern, providing relatively uniform protection whichever way the substrate is moved relative to a second page.

As is well known, the dots typically include about 20 to about 80 nanograms of phase change material and typically have a height of about 10 to about 16 microns. More typically, the height of the dots is from about 10 to about 12 microns. This is roughly the same as the height of the toner image typically produced on a paper substrate. In some instances, it may be desirable to place a second dot on top of a previous dot. Such is readily accomplished by the use of ink jet printers since the drops can be duplicated at the same location. In such instances, the height of the dot may be from about 20 to about 30 microns above the substrate surface. Of course, such doubled dots will contain double the amount of phase change material. Further, the dots may be formed as a plurality of pixels to form, for instance, a period. Typically, a period sized dot would contain 4 pixels of material, which might contain from about 80 to about 320 nanograms of phase change composition, and be from about 10 to about 16 microns in height above the substrate. It has been found that the use of such dots on a substrate surface is effective to greatly reduce the rub-off of a toner image when the toner image is brought into contact with the substrate and moved relative thereto.

Typically, the phase change composition is selected from the group consisting of polymeric materials and waxes having a melting point from about 80 to about 130° C., a melting point range of less than about 15° C., a crystalline form as a solid, a static coefficient of friction less than about 0.62, and being substantially odorless. Desirably, the melting range is less than about 10° C. Typically, the phase change material comprises at least one component selected from the group consisting of waxes, polyethylene, polyalphaolefins, and polyolefins and may contain a friction reducing material such as an organic stearate or the like. Most phase change compositions suitable for use in ink jet printers are suitable for use in the present invention if they meet the physical requirements set forth above.

Typically, the toner image produced by an electrophotographic process may also be produced by digital printing or digital copying processes, which are effectively treated by the process of the present invention.

The phase change composition is deposited on only a side of the substrate that does not carry a toner image as discussed above. The most commonly used substrate is paper.

The use of the dots in this fashion results in a marked reduction of the rub-off. Typically, the rub-off from an untreated page bearing a dense printed image pattern is from about 19 to about 25 using a 3-psi weight using the test procedure discussed hereinafter.

Test Procedure

The Test Procedure used basically involves the use of a selected weight positioned on top of a receiver sheet, which is a clean sheet of paper positioned above a toner image-bearing sheet positioned with an image-bearing side facing the receiver sheet. The toner image-bearing sheet is then slid a controlled distance under the weight on the upper sheet. The resulting discoloration of the upper sheet is then compared to a standard to produce a numeric indication of the degree of rub-off. The degree of rub-off from a clean sheet is 3.0. The rub-off of untreated toner image-bearing copies is typically from about 19 to about 25. Typically, a standard test pattern is used to test the efficiency of the dot distribution. The test sheets used for the tests herein are referred to in the copying industry as Gutenberg sheets. These sheets are sheets of alternating very closely spaced lines of images of varying sizes. Desirably, a standard image of this type is used for all tests. The dots or other treatment applied is then readily evaluated for efficacy in reducing rub-off. As indicated above, the weight used for all tests in this application was 3 psi and the tests were performed by comparing all of the samples to the same set of standards to determine rub-off evaluation numbers.

Further, rubbed patches resulting from the tests were analyzed as follows:

a) six rub-off patches were produced for each test. These test patches were first scanned on a calibrated scanner with the resulting scans or image being saved using a standard format;

b) the patch image was then evaluated and a standard deviation of the density values from each patch calculated. Applications such as Pro Shop or Math Cad can be used. It has been demonstrated that the results are identical. The standard deviation, so long as the mean density is below 0.30, has been shown to correlate with the subjective measures of the amount of toner on the sheets evaluated;

c) the standard deviations of each patch were then averaged and the statistics provided for the test samples; and, d) the average of the six standard deviations was reported as the rub-off value for any particular test.

The test sheets, as indicated, are sheets with densely spaced images across the surface of the paper. To avoid any tendency to form streaks in the test apparatus, the test sheet was turned to an angle of 7 (seven) degrees relative to the direction of movement relative to the top clean sheet. The 7-degree angle has been selected arbitrarily and can be any suitable angle so long as the printed sheet is turned to a sufficient extent to avoid a tendency to streak as a result of pulling the same letters of the sheet under the weighted area of the clean test sheet along the path of the test sheet.

A suitable test method is disclosed in U.S. patent application, U.S. Ser. No. 09/804,863 filed Mar. 13, 2001 by John R. Lawson, Gerard Darby, II, and Joe A. Basile, entitled "Rub-off Test Method and Apparatus."

EXAMPLE 1

A plurality of tests was run using square matrix arrays. A 16×16 dpi matrix pattern of dots was generated using Times New Roman font at 3, 4, 8, 12, 16 and 20 point. These dots, comprising a plurality of pixels, were applied to pre-printed documents on Hammermill 20 weight paper. Rub-off was measured as described above at 3 psi load on documents bearing toner images, which had been aged for about 100 hours. A non-treated control was used for comparison. The data is shown below in Table 1.

TABLE 1

| Point | % Area Coverage | 3-PSI Rub-off |
|---|---|---|
| Control | 0.00 | 15.0 |
| 3 | 0.34 | 10.2 |
| 4 | 0.61 | 10.8 |
| 8 | 2.43 | 6.7 |
| 12 | 5.10 | 6.5 |
| 16 | 8.00 | 6.9 |
| 20 | 16.9 | 5.2 |

EXAMPLE 2

A second set of experiments was run using a Times New Roman 4 point period in a series of dpi resolution square matrix arrays. The arrays were generated with single spots of wax at each matrix location, and double spots of wax at each matrix location as shown. (For a single spot of wax corresponding to the four-point period, the print head used actually prints four single pixel drops of wax.) These are deposited on the page as four nearest neighboring drops of wax. The 3-psi rub-off for plain paper is 3.0. With the single drops of wax applied at spacings from 10×10 dpi resolution to a value of 36×36 dpi, the rub-off decreased from about 15 to about 4.

On some of the tests, a second drop was placed on top of the first drop by simply applying a second dot on top of the first dot. For these tests, the values for the same spacings decreased from about 7 to about 3. These test results demonstrate that more wax in the dots coupled with higher drops results in better rub-off protection. The major heights of the single drops of wax are about 12 to 14 microns. The major heights for the two spots are about 20 to about 24 microns. These spots of wax apparently act as small stand-offs that keep the toner image from rubbing against the adjacent receiver material. The spots of wax also apparently allow wax to be spread and smeared against the adjacent receiver sheets to further offer rub-off protection. These spots could be considered to function as sacrificial pylons.

Figure 2:
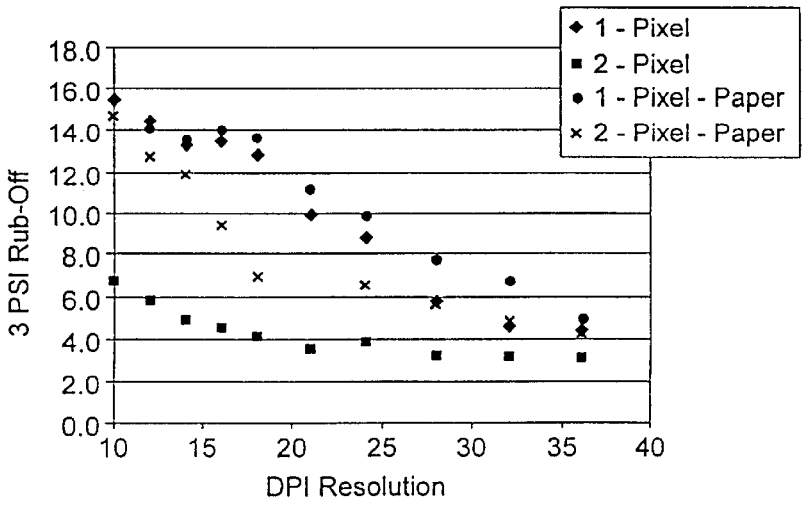
FIG. 2 shows the test results from Example 2.

The test results are shown in FIG. 2.

EXAMPLE 3

Patterns of horizontal lines at spaced distances from each other were tested as a potential way to reduce rub-off. These lines offer rub-off protection when the direction of abrasion against an adjacent sheet is orthogonal to the lines. Patterns using horizontal and vertical lines (ladder patterns) would provide rub-off protection in all directions. The ladder patterns may be produced with either single or double height lines. Both were tested and it was discovered in both instances that it is desirable that the lines be spaced at spacing less than one inch. At spacings greater than one inch, the rub-off protection is much less than that achieved at one inch or less.

EXAMPLE 4

Figure 3:
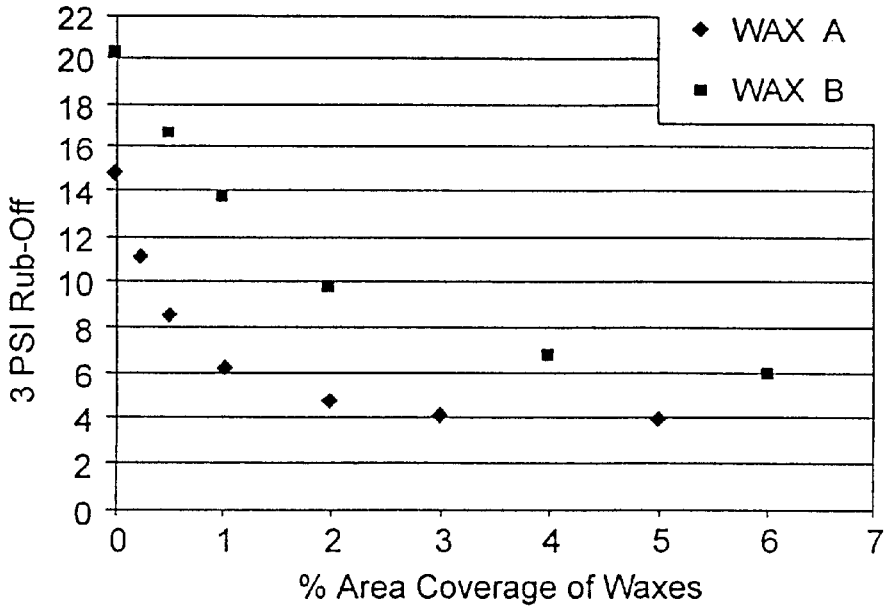
FIG. 3 shows the test results from Example 4.

Random dot patterns were generated using a random number generator. These patterns enabled the print head to emit a single pixel drop of wax of approximately 83 microns in diameter with a mass of about 80 nanograms per drop. The random patterns were used to apply wax to comparable documents. Different wax coverage is achieved by selecting a percentage of the available dots per square inch for the 300×300 dpi print resolution. For instance, five percent area coverage is a pattern in which 4,500 drops per square inch are utilized. Two waxes were used to generate random dot patterns. One wax was a polyethylene wax and the other wax was a blend of two polyalphaolefin waxes. The random dots were applied to cover varying area percentages and the 3-psi rub-off data from these tests using the two waxes is shown. The test results are shown in FIG. 3.

The test results indicate that Wax A, which was somewhat harder than Wax B, was more effective in reducing rub-off. Wax A had a melting point of about 62–64° C., and a melting range of about 10° C. Wax B had a melting point of about 60–63° C. and a melting range of 10° C.

EXAMPLE 5

A series of tests were run using random dot patterns at different dots per square inch resolutions. Tests were run at wax application levels of 0.5 percent, 1.0 percent and 2.0 percent. The test results are shown in FIG. 4.

Figure 4:
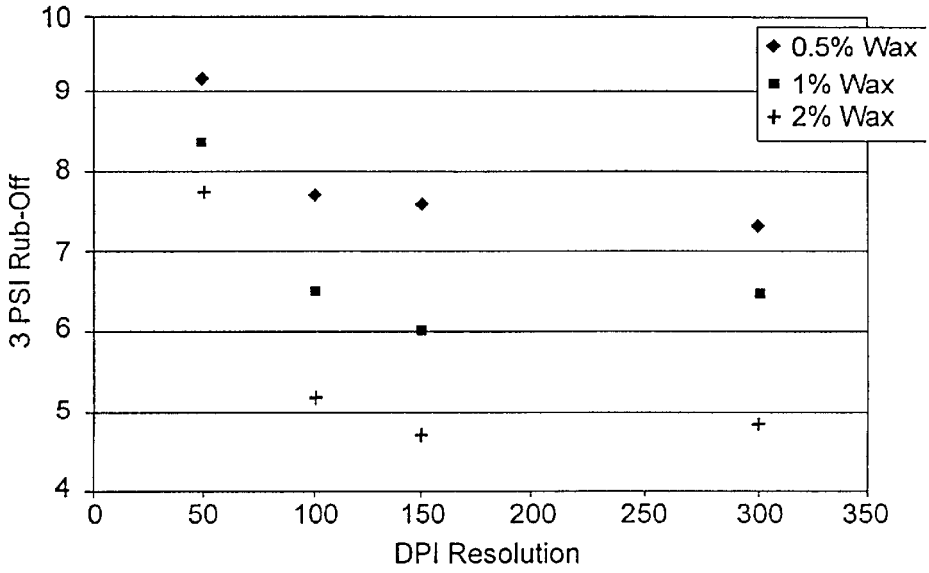
FIG. 4 graphically displays the test results from Example 5.

The 0.5 percent wax area coverage data is represented in FIG. 4 by the solid diamonds. The rub-off values decrease from about 9 down to about 7.3 as the cross-track dots per square inch resolution increases from 50 dpi to 300 dpi. The trends for the 1.0 and 2.0 percent areas coverage are similar except that the rub-off values decrease to 6.5 and 4.8 respectively. This data suggests that for patterns using random dot patterns, a 300×300 dpi resolution print head may not be required since the improvement at a 100×300 dpi range print head would appear to provide almost the same rub-off protection as the more expensive 300×300 dpi print head. Thus, a 100×300 dpi print head would provide a 3-psi rub-off value of less than 5 while using less wax material. This enables a savings in coating materials as well as in the unit manufacturing costs for the ink jet print head.

EXAMPLE 6

Figure 5:
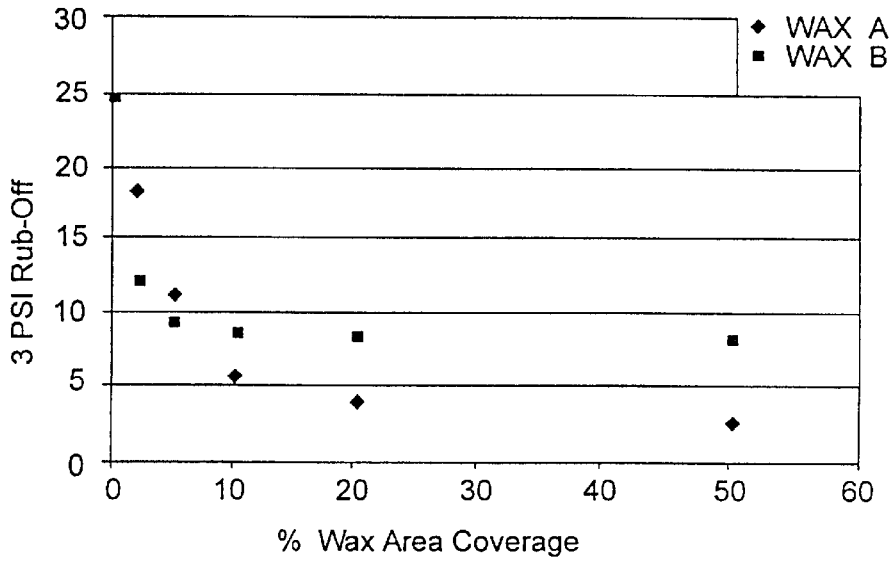
FIG. 5 shows the test results from Example 6.

The characters in any font set produced by a printer or digital copier may be used with a wax jet print head to select areas, which may be coated by wax. In other words, a 300×300 or other suitable dot per inch resolution print head may be used once the software (generated for printing or copying) is available for the generation of the instructions to coat only the characters. This would enable the use of less wax while still achieving desirable rub-off protection. The test results are shown in FIG. 5. The data represented in FIG. 5 by solid diamonds uses a polyethylene wax, which is applied on top of the toner images and nowhere else. A second wax, shown as Wax B, was also tested. The amount of wax used is minimized and the rub-off protection is maximized. Since the background areas contribute no rub-off there is no need to put wax in these areas. At about 10 percent area coverage of the characters, the rub-off value is reduced to about five. The percent wax coverage refers only to the percent coverage of the area of the images. The polyethylene wax used and shown as Wax A provides very good coverage at 10 percent area coverage of the images. Good coverage is also included at higher area coverages for the images. In fact, substantial improvement is achieved as low as five percent coverage. Wax B used was a softer polyalphaolefin wax mixture, which did not produce as good rub-off protection. This wax is not considered to provide the same height of wax as the harder polyethylene wax. Wax A had a melting point of about 62–64° C., and a melting range of about 10° C. Wax B had a melting point of about 60–63° C. and a melting range of 10° C.

EXAMPLE 7

Figure 6:
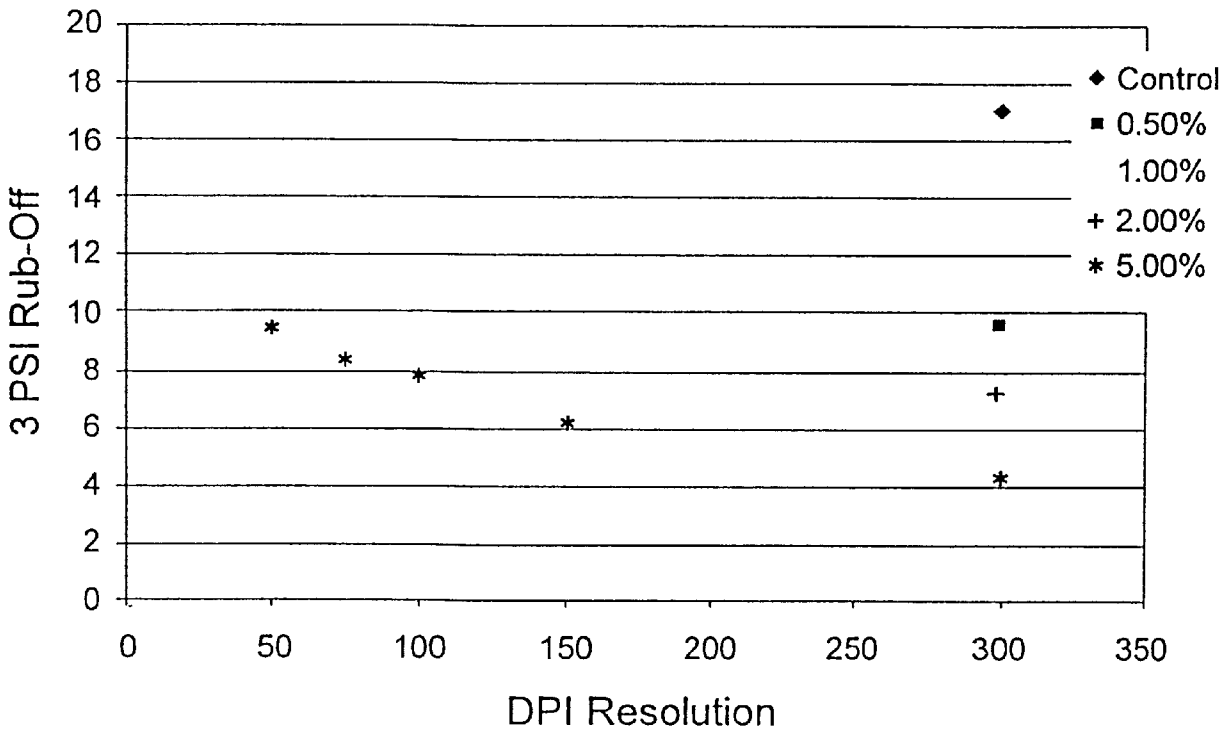
FIG. 6 shows the test results from Example 7.

An Alps ribbon printer was used to apply wax in random dot patterns at area coverages of 0.5%, 1.0%, 2.0%, and 5.0%. The data is shown in FIG. 6. At a print resolution of 300×300 dpi, the application of wax at five percent area coverage of the paper reduces the 3-psi rub-off from about 17 down to about 4. The observed trend from 50×300 dpi up to 300×300 dpi print resolution shows that improved results are achieved at the higher resolutions.

EXAMPLE 8

Tests were performed using the Alps ribbon printer and a Brothers ink jet printer at the wax area coverages shown using the same phase change composition. The test results are shown in FIG. 7.

Figure 7:
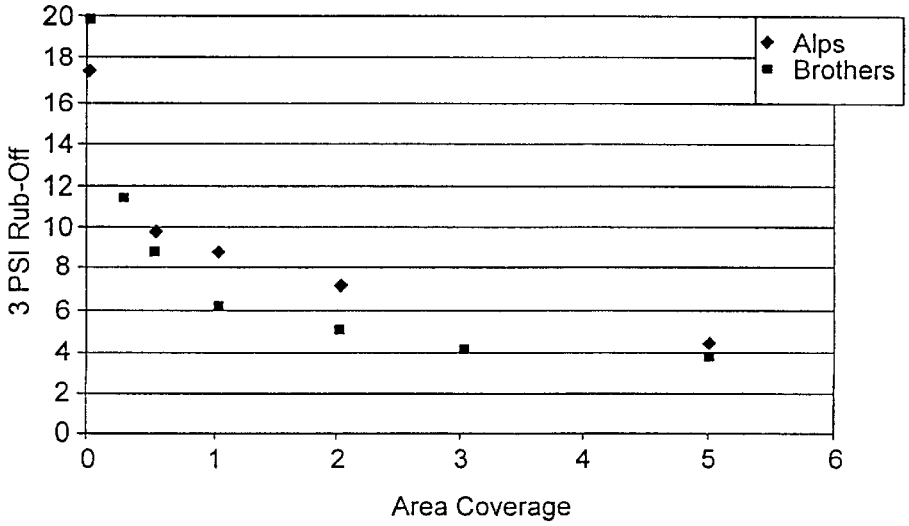
FIG. 7 shows the test results from Example 8.

FIG. 7 shows that the Alps thermal ribbon printer, phase change composition transfer process is nearly identical to the transfer process by an ink jet printer.

EXAMPLE 9

A square matrix pattern of 4 point dots was deposited onto Hammermill 20# bond paper at various dots per inch resolution form 10 dpi to 36 dpi. The plain white "protected" paper was brought into contact with its side bearing the dots in contact with a Gutenberg document, in which the Gutenberg target was tilted at 7 degrees under a load of 3 psi. The test procedure was the same as described above.

The Gutenberg document was a toner image created on a digital printer. The protectant composition was a polyethylene wax having a molecular weight of 500, a melting point of 88° C., a melt viscosity of about 5 at 149° C., and a penetration of 6.5 at 25° C.

TABLE 2

| dpi | % Area Coverage | Rub-off |
|---|---|---|
| 0 | 0.0 | 15.0 |
| 10 | 0.4 | 13.7 |
| 12 | 0.6 | 14.1 |
| 14 | 0.9 | 13.5 |
| 16 | 1.2 | 14.0 |
| 18 | 1.5 | 13.7 |
| 21 | 2.2 | 11.1 |
| 24 | 2.8 | 9.9 |
| 28 | 3.8 | 7.7 |
| 32 | 5.3 | 6.9 |
| 36 | 7.3 | 5.0 |

A perfect rub-off protection would be 3.0 at 3 psi which corresponds to the rub-off value for plain un-imaged paper.

EXAMPLE 10

A random dot pattern of the protecting composition described in example 9 above was applied to Hammermill 20 # bond paper. The same procedure described in example 9 was used to generate the following data.

TABLE 3

| % Area Coverage | Rub-off 10–16 micron |
|---|---|
| 0.0 | 19.9 |
| 0.25 | 17.1 |
| 0.50 | 16.6 |
| 1.0 | 13.1 |
| 2.0 | 9.7 |
| 3.0 | 7.3 |
| 5.0 | 4.4 |

A perfect rub-off score is 3.0

As the above data show, the rub-off protection improves as the area coverage increases. At area coverages of 5% and above, excellent protection is afforded.

It should be well understood that the use of the method of the present invention can be implemented by the use of an ink jet printer or the like to coat substrates bearing a toner image as they are produced in a printer or copier machine. The prints can be produced by analog electrophotography, digitally or the like. Further, the ink jet, or the like, dot application system may be implemented as a part of the photocopier or printer machine, or as a stand-alone unit, which may apply rub-off reducing material in a separate step.

Many variations are possible within the scope of the present invention and many such variations may be considered obvious and desirable by those skilled in the art. For instance, a wide variety of wax and polymeric materials having the physical properties set forth above may be found effective. Further, it may be found desirable to imprint an indication of reduced rub-off treatment at the same time as the dots are applied in order to provide promotional labeling for treatment by the method of the present invention or it may be desirable to print colored images over a portion of the substrate as the dots are applied. Such variations are considered to be well known to those skilled in the art.

As discussed previously, the development and use of a variety of polymeric and wax materials having suitable properties for use in ink jet printers or the like for use as carriers for phase change inks and the like are well known. Many of these materials have been shown in patents referred to herein and in other patents available as open literature. Further, the use of ink jets is well known to those skilled in the art and a variety of systems for applying ink jet images to substrates is available on the open market.

Having disclosed the present invention by reference to certain of its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon the foregoing description of preferred embodiments.

Having thus described the invention, I claim:

1. A method for reducing rub-off by employing a substrate having a front side and a back side and bearing a toner image on only one of said sides, the method comprising: depositing a phase change composition on the side of the substrate that does not bear an image as a plurality of dots, said dots cumulatively covering an area of said side sufficient to reduce rub-off from an adjacent image bearing side of a separate substrate.

2. The method of claim 1 wherein the dots cumulatively cover from about 0.25 to about 8.00 percent of the area of the side of the substrate.

3. The method of claim 1 wherein the dots are deposited on the front side of the substrate by at least one of an inkjet printer, ribbon printer or diffusion printer.

4. The method of claim 3 wherein the dots are arranged in a matrix pattern.

5. The method of claim 4 wherein the dots are deposited by a printer having a cross-track to in-track resolution from about 50×300 to about 300×300 dpi.

6. The method of claim 5 wherein the resolution is at least about 100×300 dpi.

7. The method of claim 4 wherein the dots are arranged in a square matrix array.

8. The method of claim 4 wherein the dots are arranged to form lines.

9. The method of claim 8 wherein the lines are parallel and are spaced apart at a distance less than 1 inch.

10. The method of claim 9 wherein the lines are positioned to form a grid of intersecting parallel lines.

11. The method of claim 10 wherein the parallel lines are spaced apart at a distance less than about 1 inch.

12. The method of claim 3 wherein the dots are arranged in a random matrix pattern.

13. The method of claim 3 wherein at least a majority of the dots each contain from about 20 to about 80 nanograms of phase change composition.

14. The method of claim 3 wherein the dots are from about 10 to about 16 microns in height above the substrate surface.

15. The method of claim 3 wherein the dots contain from about 40 to about 160 nanograms of phase change composition and wherein the dots are from about 10 to about 16 microns in height above the substrate surface.

16. The method of claim 3 wherein the dots contain from about 80 to about 320 nanograms of phase change composition and are from about 20 to about 30 microns in height above the substrate surface.

17. The method of claim 1 wherein the phase change composition is selected from the group consisting of polymeric materials and waxes having a melting point from about 80 to about 130° C., a melting range of less than about 15° C., a crystalline form as a solid, a static coefficient of friction less than about 0.62 and being substantially odorless.

18. The method of claim 17 wherein the melting range is less than about 10° C.

19. The method of claim 17 wherein the phase change composition comprises at least one component selected from the group consisting of waxes, polyethylene, polyalphaolefins, and polyolefins.

20. The method of claim 1 wherein the substrate bearing a toner image is produced by an electrophotographic process.

21. The method of claim 1 wherein the substrate bears a toner image on only the front side and wherein the phase change composition is deposited on only the back side of the substrate.

22. The method of claim 1 wherein the substrate is paper.

23. A method for reducing rub-off by employing a substrate having a front side and a back side and bearing no toner image on either side, the method comprising: depositing a phase change composition on one side of the substrate as a plurality of dots, said dots cumulatively covering an area of said side sufficient to reduce rub-off from an adjacent image bearing side of a separate substrate.

24. The method of claim 23 wherein the dots cumulatively cover from about 0.25 to about 8.00 percent of the images.

25. The method of claim 23 wherein the dots are deposited by at least one of an ink jet printer, a ribbon printer and a diffusion printer.

26. The method of claim 25 wherein the dots are arranged in a matrix pattern.

27. The method of claim 26 wherein the dots are deposited by a printer having a cross-track to in-track resolution from about 50×300 to about 300×300 dpi.

28. The method of claim 27 wherein the resolution is at least about 100×300 dpi.

29. The method of claim 26 wherein the dots are arranged in a random matrix pattern.

30. The method of claim 25 wherein at least a majority of the dots contain from about 20 to about 80 nanograms of phase change composition.

31. The method of claim 23 wherein the dots are from about 10 to about 16 microns in height above the substrate surface.

32. The method of claim 23 wherein the phase change composition is selected from the group consisting of polymeric materials and waxes having a melting point from about 80 to about 130° C., a melting range of less than about 15° C., a crystalline form as a solid, static coefficient of friction less than about 0.62 and being substantially odorless.

33. The method of claim 32 wherein the range is less than about 10° C.

34. The method of claim 32 wherein the phases change composition comprises at least one component selected from the group consisting of waxes, polyethylene, polyalphaolefins, and polyolefins.

35. The method of claim 23 wherein the substrate has a toner image on both the front side and on the backside and wherein phase change composition is deposited on the toner images on both sides of the substrate.

36. The method of claim 23 wherein the substrate is paper.

* * * * *